US012509846B2

(12) United States Patent
Di Stefano

(10) Patent No.: US 12,509,846 B2
(45) Date of Patent: Dec. 30, 2025

(54) QUICK-CHANGE UNIT AND QUICK-CHANGE SYSTEM

(71) Applicant: QCS QuickChangeSystem EMUK GmbH, Landau (DE)

(72) Inventor: Salvatore Di Stefano, Billigheim-Ingenheim (DE)

(73) Assignee: QCS QuickChangeSystem EMUK GmbH, Landau (DE)

( * ) Notice: Subject to any disclaimer, the term of this patent is extended or adjusted under 35 U.S.C. 154(b) by 422 days.

(21) Appl. No.: 18/040,556

(22) PCT Filed: Jul. 28, 2021

(86) PCT No.: PCT/EP2021/071102
§ 371 (c)(1),
(2) Date: Feb. 3, 2023

(87) PCT Pub. No.: WO2022/028974
PCT Pub. Date: Feb. 10, 2022

(65) Prior Publication Data

US 2023/0313485 A1 Oct. 5, 2023

(30) Foreign Application Priority Data

Aug. 6, 2020 (EP) ..... 20189849

(51) Int. Cl.
*E02F 3/36* (2006.01)

(52) U.S. Cl.
CPC ..... *E02F 3/3654* (2013.01); *E02F 3/3622* (2013.01); *E02F 3/3627* (2013.01); *E02F 3/3663* (2013.01)

(58) Field of Classification Search
None
See application file for complete search history.

(56) References Cited

U.S. PATENT DOCUMENTS

| | | | | |
|---|---|---|---|---|
| 6,196,595 | B1 * | 3/2001 | Sonerud | E02F 3/3663 37/468 |
| 7,464,967 | B2 * | 12/2008 | Mieger | B60D 1/62 37/468 |
| 2011/0262212 | A1 | 10/2011 | Luyendijk et al. | |
| 2012/0128404 | A1 * | 5/2012 | Sonerud | E02F 3/3627 403/31 |

FOREIGN PATENT DOCUMENTS

| | | |
|---|---|---|
| DE | 102017122889 | 4/2019 |
| EP | 2096212 | 9/2009 |
| WO | WO9101414 | 2/1991 |
| WO | WO2016107703 | 7/2016 |

* cited by examiner

*Primary Examiner* — Michael S Lowe
(74) *Attorney, Agent, or Firm* — McHale & Slavin, P.A.

(57) ABSTRACT

A quick coupler for construction machines. An embodiment of the quick coupler comprises a housing with two opposing longitudinal walls, two opposing transverse walls, a top side, a bottom side, and a block cylinder inside the housing. The quick coupler may also comprise a locking device with a locking bolt and a drive device. The locking bolt protrudes from one of the two transverse walls in a locked position. The quick coupler may also comprise a first coupling element having a coupling end section and a second coupling element having a coupling end section hydraulically connected to one another, wherein the second coupling element is arranged on one of the two longitudinal walls of the housing.

18 Claims, 13 Drawing Sheets

QUICK-CHANGE UNIT AND QUICK-CHANGE SYSTEM

CROSS REFERENCE TO RELATED APPLICATIONS

This is a national stage filing in accordance with 35 U.S.C. § 371 of PCT/EP2021/071102, filed Jul. 28, 2021, which claims the benefit of the priority of European Patent Application No. 20189849.1, filed Aug. 6, 2020, the contents of each are incorporated herein by reference.

TECHNICAL AREA

The present invention relates to a quick coupler and a quick coupler system.

STATE OF THE ART

Construction machines can cover a wide range of applications with interchangeable attachments, e.g. hydraulic grabs, digging buckets, grapples and the like. To enable maximum flexibility, it is essential that the change between attachments can be made quickly and safely. For this purpose, there are quick-change devices for construction machines that comprise a quick coupler on the vehicle side (i.e. on the boom side) and an adapter on the tool side, which can be easily coupled with each other without the driver having to leave the vehicle and do it manually.

For this purpose, means are usually provided on the quick coupler and on the frame-like adapter in order to create a mechanical connection between the quick coupler and the adapter. Usually, these are a projection and a pair of movable locking bolts on the quick coupler, whereby the projection and locking bolts are arranged on opposite sides of the quick coupler. On the frame-type adapter, a transverse bolt for hooking the quick coupler projection and two parallel locking holes for the pair of locking bolts are provided accordingly.

The connection between quick couplers and adapters as known in the art takes place in two stages. In the first stage, the quick coupler is usually positioned at an angle to the adapter in such a way that the projection arranged on the quick coupler embraces the transverse bolt arranged on the opposite adapter. The quick coupler then swivels into a locked position where the frame of the adapter can embrace the quick coupler, with the horizontal plane of the quick coupler now aligned parallel to the horizontal plane of the adapter. In the second stage, the pair of locking bolts located on the quick coupler moves longitudinally into the corresponding locking holes on the opposite adapter, creating a secure lock between the quick coupler and the adapter.

The movable pair of locking bolts of the quick coupler is usually coupled to a hydraulic drive that can be moved along its longitudinal axis, which in turn is fed with pressurised hydraulic fluid from the hydraulic system of the construction machine.

For this purpose, known quick couplers usually have one or more hydraulic connections (coupling elements) with corresponding valves on the top of the quick coupler, which extend via corresponding recesses in a housing of the quick coupler to a block cylinder arranged inside the housing. The block cylinder in turn is in hydraulic connection with the hydraulic drive of the locking bott pair.

These coupling elements serve to quickly couple the quick coupler to the hydraulic system of the construction machine by coupling a hydraulic hose of the construction machine to each coupling element of the quick coupler by means of a corresponding counter-coupling element at the end of each hydraulic hose. Via these coupling elements on the quick coupler, the hydraulic drive of the quick coupler can be supplied with pressurised hydraulic fluid and controlled accordingly. Control is conveniently from the operator's cab of the construction machine.

DE 10 2017 122 889 A1 has recognised that this arrangement of the hydraulic connection on the upper side of the quick coupler has the disadvantage that the quick coupler is relatively high, which means that the excavator arm can only engage with the housing of the quick coupler at a predetermined distance. As a solution, DE 10 2017 122 889 A1 proposes to remove the corresponding valve of the hydraulic connection from the upper area of the block cylinder and to insert it into a side of the block cylinder extending transversely to the longitudinal axis, so that the bore in the block cylinder is located next to the bores of a pair of locking bolts. This avoids an elevated construction on the upper side of the quick coupler.

Usually, additional coupling elements are provided on the upper side of the quick coupler, which are coupled with further lines of the construction machine via counter-coupling elements. These additional coupling elements are in hydraulic connection with further coupling elements on the underside of the quick coupler. The additional coupling elements on the underside of the quick coupler can in turn be connected to one or more counter-coupling elements on the tool side of the adapter, so that the hydraulic circuit on the vehicle side can be coupled to a hydraulic circuit on the tool side via the quick coupler, cf. e.g. WO 91/01414.

However, in order to change between tools, the connection between the further coupling elements on the underside of the quick coupler and the counter-coupling elements of the adapter must be released. The further coupling elements on the underside of the quick coupler are thus exposed to the weather conditions and the conditions on a construction site, especially exposed to dust and dirt.

If, for example, dirt settles on the further coupling elements of the quick coupler, it can get into the interior of the quick coupler when it is connected to the counter coupling elements of a further adapter and clog the valve inside the further coupling elements of the quick coupler. It is a known problem with quick couplers that the further coupling elements for coupling adapters are frequently defective and have to be replaced. The present invention aims to at least significantly reduce, and preferably completely avoid, this disadvantage of known quick coupler systems. In addition, at least the wear on the counter coupling elements on the adapter due to exposure to dirt and dust is to be reduced.

DESCRIPTION OF THE INVENTION

It is therefore the object of the present invention to provide a quick coupler and a quick coupler system which are easy to handle, compact in design and whose coupling elements can be particularly protected against dirt and the effects of the weather and consequently against premature wear.

According to the invention, the object is solved by providing a quick coupler with the features according to main claim 1 and a quick coupler system according to claim 16.

Preferred embodiments can be found in the subclaims.

The quick coupler according to the invention comprises a housing with two opposing longitudinal walls, two opposing transverse walls, a top side and a bottom side, a block cylinder inside the housing, a locking device with at least one locking bolt and a drive device, wherein the at least one locking bolt protrudes from one of the two transverse walls in a locked position, at least one coupling element of the first type having a coupling end section and at least one coupling element of the second type having a coupling end section, wherein the at least one coupling element of the first type and the at least one coupling element of the second type are hydraulically connected to one another and wherein the at least one coupling element of the second type is arranged on one of the two longitudinal walls of the housing.

The invention thus elegantly solves a practical problem of the prior art. This is because the coupling elements of the second type must be easily accessible so that counter coupling elements of hydraulic hoses of the construction machine can be coupled or the coupling elements can be coupled with the counter coupling elements of an adapter. However, due to the required compactness of the quick coupler and the position of the quick coupler between the adapter and the boom of a construction machine, the possibilities for the arrangement of the coupling elements are limited, which leads to the fact that they are usually arranged on the top side and/or the bottom side of the quick coupler. There, however, in the uncoupled state, they are particularly exposed to weather conditions as well as to the dirt of a construction site, as a result of which they often suffer damage. This applies in particular to the coupling elements of the second type, as these remain uncoupled more frequently.

The coupling element of the second type which is positioned on the longitudinal wall of the housing offers the particular advantage that exposure to weather conditions is significantly reduced here. This is because, for example, raindrops simply run off to the side of the quick coupler, so that no water can remain on the coupling elements. The same applies to snow, for example, and it is also more difficult for dirt to adhere to the sides than, for example, to the top or bottom of the quick coupler.

Due to the fact that the locking bolt and the coupling element of the second type are arranged on two housing walls that are perpendicular to each other, the quick coupler is particularly easy to handle, as the side with the at least one coupling element of the second type is still accessible even when the quick coupler is locked with an adapter.

The feature of hydraulic connection between the coupling element of the first type and the coupling element of the second type is to be interpreted broadly according to the invention. It simply means that a fluid flow is possible between the coupling element of the first type and the coupling element of the second type. The coupling element of the first type and the coupling element of the second type can be provided in the forward or in the return flow, depending on the application.

Preferably, several coupling elements of the first type and/or coupling elements of the second type are provided.

The term coupling element is to be interpreted broadly. Preferably, it means a valve with, if applicable, corresponding devices for conducting pressurised hydraulic fluid in a couplable protective housing, which can be constructed in one or more parts, as is customary in the state of the art for coupling counter coupling elements of a construction machine or an adapter. However, the term coupling element in the present application also means a common valve or a valve with a hydraulic connection and a plug.

By the term coupling end section, the present invention means that section of the coupling elements which is used for coupling with counter coupling elements.

In a preferred further development, the at least one coupling element of the first type is arranged on a longitudinal wall of the housing. On the one hand, this protects the coupling element of the first type from environmental influences and, on the other hand, the coupling element is easily accessible even in the installed and locked state.

It is further preferred that at least the coupling end section of the coupling element of the second type is adjustable between an operating position and a basic position, wherein the coupling end section of the coupling element of the second type protrudes from the longitudinal wall of the housing in the operating position. Then, corresponding counter coupling elements of the construction machine or the adapter can be coupled to said coupling end section.

The basic position of the coupling element of the second type is characterized by the fact that the coupling element of the second type is arranged on the housing of the quick coupler in such a way that it is largely protected from exposure to dirt and dust, rain, snow, etc., which means it is in a protective position. In the operating position, on the other hand, the coupling element of the second type is positioned in such a way that it can be coupled to a counter coupling element of the hydraulic hose of the construction machine or to a counter coupling element of the adapter for tools.

The present invention pursues an approach in which the coupling elements of the quick coupler are adjustable, in particular movable, tiltable and/or pivotable, between a basic position (protective position) and an operating position (coupling position) and vice versa. In this way, the coupling elements can be arranged in places of the quick coupler that are easily accessible for the counter-coupling elements, but are protected from harmful external influences in the protective position. Depending on the positioning of the coupling elements of the second type inside the housing, they can be shifted, pivoted, tilted or moved to change from a basic position to an operating position.

It is preferred that the coupling end section of the coupling element of the second type is located inside the housing in the basic position. In this way, the coupling end section of the coupling element of the second type and the entire coupling element of the second type are protected from exposure to dust or dirt and from the effects of the weather in the basic position. If, for example, the coupling element of the second type is not required because the working tool does not need to be supplied with hydraulic fluid, the coupling element of the second type can remain protected in the basic position. Even when changing from one adapter to the next, the coupling element of the second type can preferably be retracted into the housing and only extended when it is needed again.

In particular, it is advantageous that the at least one coupling element of the second type is connected to a coupling drive device so that at least the second coupling end section of the coupling element of the second type is adjustable between the basic position and the operating position and vice versa.

In a preferred embodiment, the coupling drive device comprises at least one linear drive mounted in the block cylinder. The linear drive of the coupling drive device serves to move at least the coupling end section of the at least one coupling element of the second type linearly between the basic position and the operating position.

The at least one linear drive is preferably a hydraulic drive. In a preferred embodiment it is provided that the coupling drive device can be hydraulically connected to at least one coupling element of a third type, so that said linear drive can be coupled to the hydraulic system of a construction machine In a preferred embodiment, at least one coupling element of a third type is provided, which is preferably positioned in a longitudinal wall of the housing. The coupling element of the third type is generally used to supply hydraulic devices inside the quick coupler with the corresponding fluid. It is thus positioned in the forward or return flow of supply lines. The coupling element of the third type can, for example, be hydraulically connected to the coupling drive device or to a hydraulically actuated locking device.

The coupling element of the third type can correspond in design to the coupling element of the first type, whereby this coupling element of the third type is not hydraulically connected to a coupling element of the second type, but serves to control the hydraulic drives of the quick coupler, in this case to control the coupling drive device, preferably conveniently from the driver's cab of the construction machine.

It is further preferred that the quick coupler is equipped with at least two coupling elements of the second type, wherein at least the coupling end sections of the coupling elements of the second type are synchronously adjustable between the basic position and the operating position and vice versa. For example, at least two coupling elements of the second type are provided, which are positioned on opposite longitudinal walls of the housing and are adjustable by means of a common coupling drive device. Particularly in this embodiment, it is advantageous that the coupling drive device has a double-acting hydraulic cylinder which is preferably aligned parallel to the transverse wall of the housing. Thus, two coupling elements of the second type can be actuated simultaneously on two different longitudinal walls.

It goes without saying that any number of adjustable coupling elements of the second type can be provided on both longitudinal walls. The number of adjustable coupling elements of the second type can be identical or different on both longitudinal walls. The arrangement of the coupling elements of the second type on both longitudinal walls can be symmetrical or asymmetrical, preferably it is mirror symmetrical.

Even with a plurality of adjustable coupling elements of the second type on one longitudinal wall, these can be actuated by means of a double-acting hydraulic cylinder if, for example, the hydraulic cylinder interacts with a coupling bridge against which the coupling elements of the second type rest.

In a preferred embodiment, the locking device comprises at least two locking bolts which point in opposite directions and are adjustable between a closed position and an open position and vice versa by means of a common drive device. This creates a particularly secure connection between an adapter and a quick coupler, as locking between adapter and quick coupler takes place on two opposite sides.

In order to actuate the two opposing locking bolts, it is advantageous that the locking drive device has a double-acting hydraulic cylinder which is preferably aligned parallel to the longitudinal wall of the housing.

A particularly secure locking device is obtained by providing a pair of locking bolts on each transverse side, which are arranged parallel to and spaced apart from each other, the two pairs of locking bolts being adjustable between a closed position and an open position and vice versa by means of a common drive device. Preferably, the two locking bolts can be moved separately from each other, but they can also be moved synchronously.

These locking bolts can be actuated, for example, by means of a hydraulic cylinder that can be acted upon from two sides, which is part of the drive device and interacts with a locking bridge.

In a preferred further embodiment, it is provided that the drive device is at least one linear hydraulic drive which is hydraulically connected to at least one coupling element of a third type.

An embodiment in which the double-acting hydraulic cylinder of the locking drive device is arranged parallel to the longitudinal wall of the housing and the double-acting hydraulic cylinder of the coupling drive device is arranged parallel to the transverse wall of the housing has the advantage that they can be arranged in two planes so that the coupling element and the locking bolts, and thus the coupling and the locking function of the quick coupler, do not influence each other.

Preferably, the hydraulic connection is made by means of a block cylinder. The coupling element of the first type and the coupling element of the second type can be directly connected or connectable to each other via a line, which is guided through the block cylinder, for example, However, the pressurized hydraulic fluid can also be guided into the block cylinder via the coupling element of the first type and forwarded to the coupling element of the second type via a distribution device or other devices in the block cylinder for example. Also, several coupling elements of the first type can be hydraulically connected to one or more coupling elements of the second type and vice versa.

It is advantageous that the block cylinder comprises a first block cylinder and a second block cylinder, wherein the second block cylinder is positioned below the first block cylinder, wherein the at least one coupling element of the second type is provided in the first block cylinder and wherein at least a part of the locking device is positioned in the plane of the second block cylinder. Thus, the locking device can be actuated independently of the coupling elements and can be supplied with a fluid if required.

The second block cylinder is preferably firmly connected to the first block cylinder, e.g. via screws, gluing, plugging, or is welded to it or even integrally formed with the first block cylinder.

If, in a preferred embodiment, it is provided that the locking device comprises at least one drive device with a locking piston, with said locking piston serving to drive the at least two locking bolts, it is advantageous that the locking piston is positioned inside the second block cylinder. This enables a very compact design.

In an embodiment in which at least the coupling end section of the coupling element of the second type is adjustable between an operating position and a basic position and in which a coupling drive device is provided, it is advantageous that the coupling drive device is positioned in the first block cylinder.

In order to arrange a hydraulic drive for a locking device and a plurality of coupling elements in a particularly compact manner, it is advantageous that an opening for the coupling element of the second type is provided in a longitudinal wall of the block cylinder and that an opening is provided in the second block cylinder at the transverse side of the block cylinder.

In order to be able to easily install adjustable coupling elements of the second type in the quick coupler, it is preferred that the first block cylinder is T-shaped in cross-section with a base and a roof, whereby the at least one coupling element of the first type is positioned in the plane of the roof and the at least one coupling element of the second type is positioned in the plane of the base. Thus, even larger and more elaborately designed coupling elements of the second type have sufficient space available inside the housing.

The present invention further comprises a quick coupler system comprising the described quick coupler and an adapter connectable to a working tool, wherein the quick coupler is mechanically and hydraulically couplable to the adapter.

In a preferred embodiment, the adapter comprises two opposing longitudinal adapter sides and at least two transverse bolts, wherein the at least two transverse bolts are each connected at their end sections to the longitudinal adapter sides of the adapter in a bearing-like manner.

With this embodiment, the changeover time from one adapter to the next can be significantly reduced, since, among other things, the complicated embracing of a transverse bolt of the adapter with a projection on the quick coupler can be omitted.

In a preferred embodiment, it is provided that at least one counter coupling element of the second type is positioned on at least one longitudinal wall of the adapter, wherein said counter coupling element can be connected to the at least one coupling element of the second type. The counter coupling element of the second type is preferably positioned on the inner sides of the longitudinal walls of the adapter.

It has proven advantageous that the counter coupling element of the second type is formed as a connection block, which is preferably provided on the outside of the adapter. For example, the connection block can divert outlets in a side wall so that they are more easily accessible.

BRIEF DESCRIPTION OF THE DRAWINGS

Examples of embodiments of the invention are explained in more detail in the following drawings. However, the invention is by no means limited to these specific examples of embodiment, in which.

BEST WAY TO CARRY OUT THE INVENTION AND INDUSTRIAL APPLICABILITY

Figure 1:
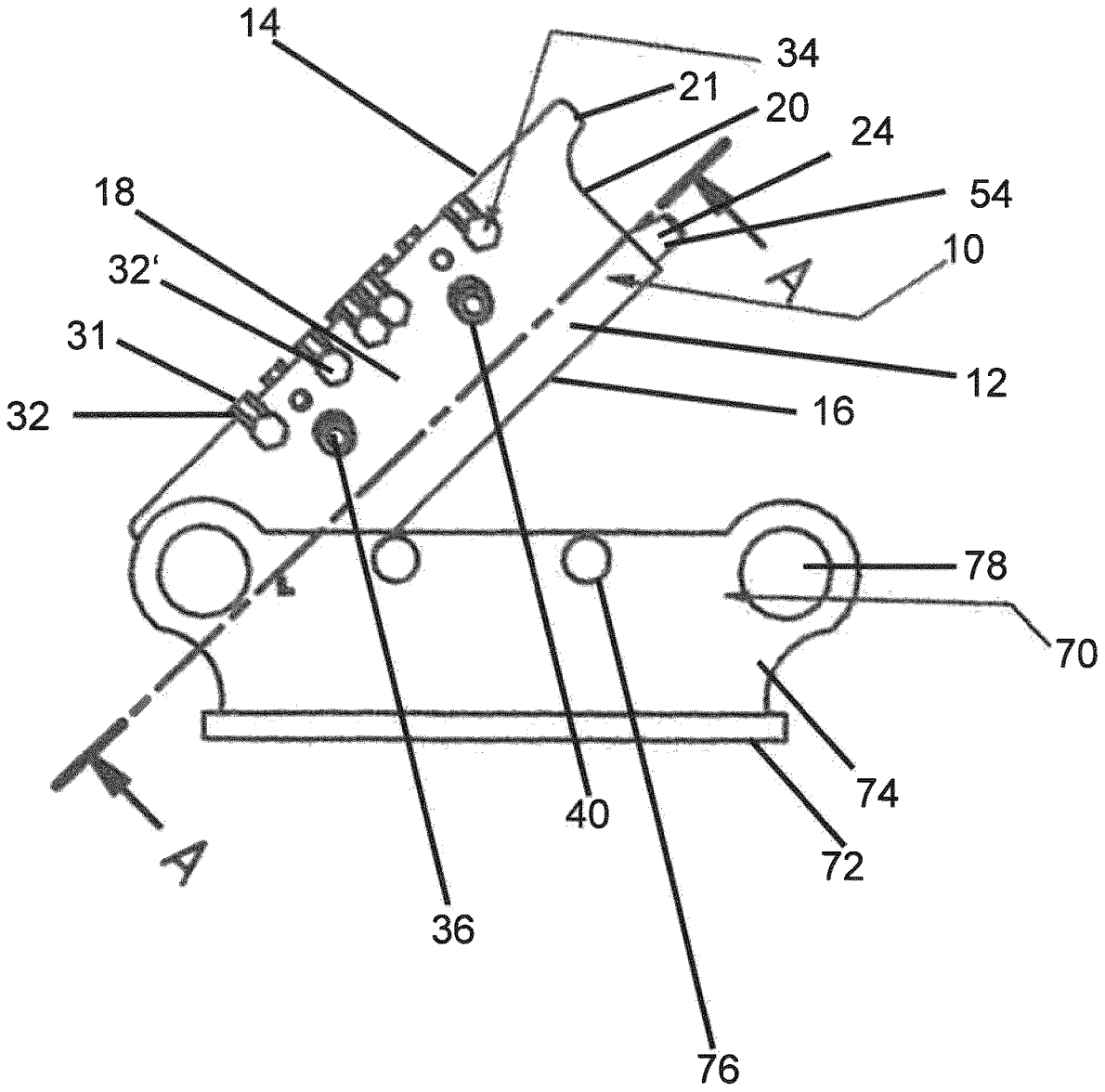
FIG. 1 shows a side view of the quick coupler system.

FIG. 1 shows a side view of the quick coupler system. The quick coupler system consists of a quick coupler 10 and an adapter 70, which can be coupled together.

Figure 3:
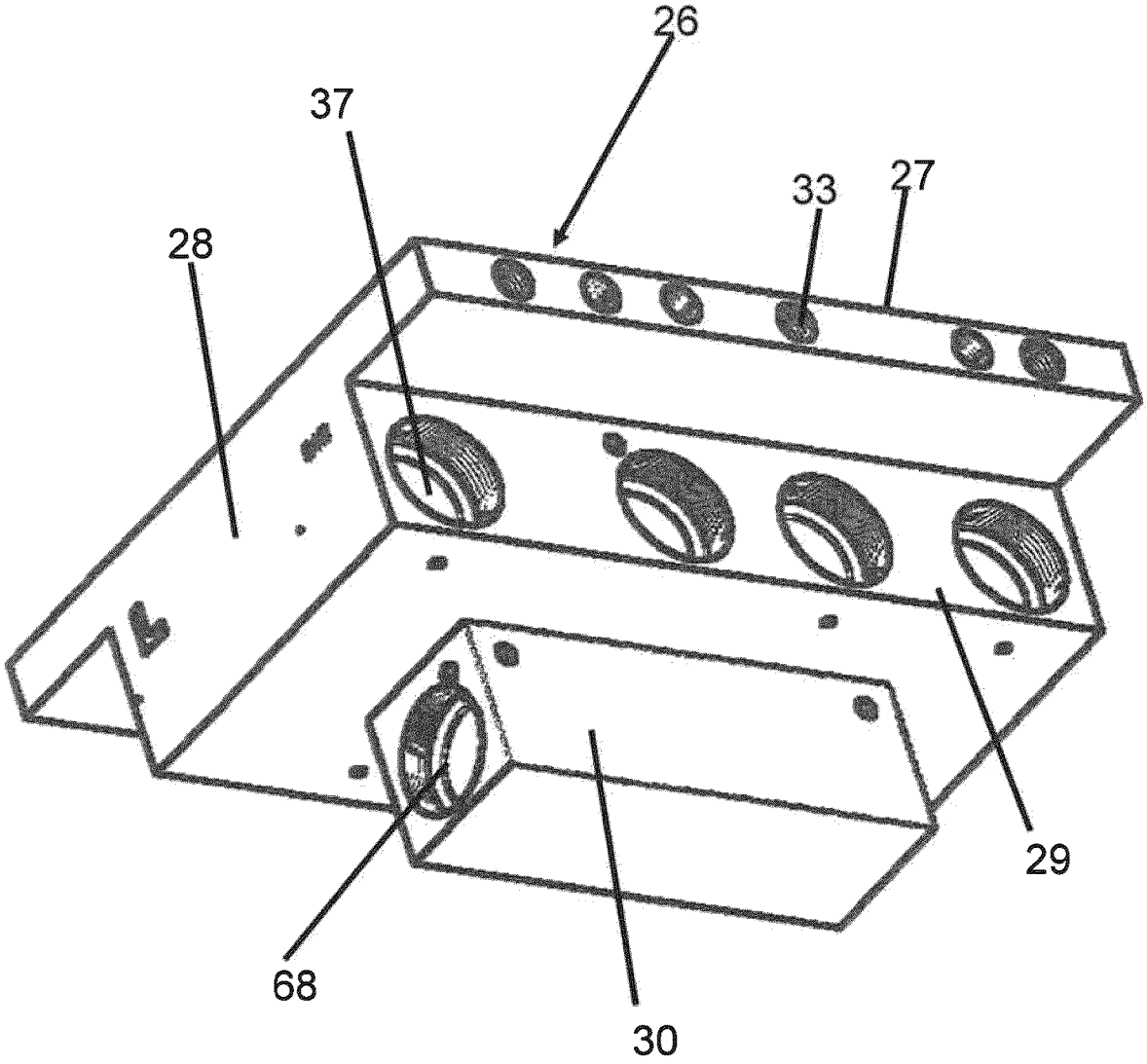
FIG. 3 shows a perspective view of the double block cylinder.

The quick coupler 10 comprises a housing 12 with an upper housing wall 14 on the construction machine side or boom side, a lower housing wall 16 arranged opposite thereto and side walls, namely two housing longitudinal walls 18 arranged opposite to each other and two housing transverse walls 20 extending transversely to a longitudinal axis of the quick coupler 10, as well as a two-storey block cylinder 26 with a first block cylinder 28 and a second block cylinder 30 inside the housing (see FIG. 3).

A plurality of coupling elements of the first type 32, coupling elements of the second type 36 and coupling elements of the third type 32' are respectively mounted in corresponding openings 22 in the housing 12 on the mutually opposite longitudinal housing walls 18 of the quick coupler 10. The coupling elements of the second type 36 extend perpendicularly to the longitudinal housing wall 18 of the housing 12, while the coupling elements of the first type 32 and the third type 32' are angled and point with their free end in the direction of the upper housing wall 14, the coupling elements of the first type 32 and the third type 32 'are essentially identical in construction, but differ in their function as will be explained further below.

No coupling elements of the first type 32 or coupling elements of the third type 32' and especially no coupling elements of the second type 36 are arranged on the upper housing wall 14 on the side of the construction machine or on the side of the boom, on the lower housing wall 16 arranged opposite thereto or on the transverse housing walls 20 of the housing 12.

In addition, FIG. 1 shows a pair of locking bolts 54 arranged perpendicular to each housing transverse wall 20 and extending into the interior of the housing 12 via respective openings in the housing transverse walls 20 of the housing 12. The two pairs of locking bolts 54 are movable in opposite directions between a closed position and an open position and vice versa via said openings of the housing 12. For this purpose, a locking device 24 is provided inside the housing 12, which will be discussed in more detail below.

The longitudinal axis of the quick coupler 10 is defined by the direction of extension of the locking bolts 54 of the locking device 24 and corresponds to the longitudinal axis of conventional quick couplers according to the state of the art.

The shape of the housing 12 is composed of a main section that is rectangular in cross-section and two projections 21, each of which is provided on a transverse wall 20 of the housing (with only one projection 21 shown in FIG. 1). The transition from the main section of the quick coupler 10 to the projections 21 is smooth.

The adapter 70 comprises an adapter base 72 and two longitudinal adapter sides 74 extending parallel in the longitudinal direction of the adapter 70.

Each longitudinal adapter side 74 of the adapter 70 has, in the upper region, two bores positioned opposite one another, in each of which an end section of a transverse bolt 78 is mounted, so that the two longitudinal adapter sides 74 are connected to one another via two transverse bolts 78.

Furthermore, two schematically indicated counter coupling elements of the second type 76 are located in the longitudinal adapter sides 74 of the adapter 70.

Each counter coupling element of the second type 76 of the adapter 70 is connectable to a hydraulic hose, not shown, which runs to a tool, not shown, to which the adapter 70 is connectable. The coupling element of the second type 36 is used for coupling with corresponding counter coupling elements of the second type 76 of the adapter 70 for controlling a hydraulically operated tool.

The coupling element of the first type 32 or the coupling element of the third type 32' is used for coupling with counter coupling elements of the first type, not shown, via hydraulic hoses of a construction machine.

The main functional difference between a coupling element of the first type 32 and a coupling element of the third type 32' is that each coupling element of the first type 32 is hydraulically connected to at least one coupling element of the second type 36, which serves to supply and/or return hydraulic fluid between the coupling element of the first type 32 and the coupling element of the second type 36. In contrast, the coupling elements of the third kind 32' do not serve to supply and/or return hydraulic fluid to the coupling elements of the second kind 36, but to supply hydraulic drives arranged inside the housing 12. The coupling element of the third type 32' and the coupling element of the second type 36 are therefore not hydraulically connected to each other.

Each coupling element of the first type 32 or coupling element of the third type 32' comprises a respective coupling section 31. Each coupling element of the first type 32 or coupling element of the third type 32' extends outwards through a recess in the longitudinal wall 18 of the housing 12 perpendicular to the longitudinal wall 18 of the housing and passes at an angle into the coupling end section 31 of the coupling element of the first type 32 or coupling element of the third type 32' so that the coupling end section of each coupling element of the first type 32 or coupling element of the third type 32' points upwards.

Each of the coupling elements of the first type 32 or the coupling elements of the third type 32' is screwed to the housing 12 of the quick coupler 10 by means of a swivel screw fitting 34.

Inside each coupling element of the first type 32 or coupling element of the third type 32' there is preferably a valve which is open in the coupled state and closed in the uncoupled state. In addition, further devices can be located inside each coupling element of the first type 32 or coupling element of the third type 32', which serve, for example, to forward and/or return hydraulic fluid in the coupled state and to ensure fluid tightness.

The coupling element of the first type 32 or the coupling element of the third type 32' is preferably a quick-release coupling element, which can be designed as a male or female coupling element. The coupling elements of the first type 32 and the third type 32' are firmly connected to the housing 12.

The coupling elements of the second type 36, on the other hand, are hydraulically movable or displaceable linearly perpendicular to the longitudinal housing walls 18 of the quick coupler 10 between a basic position and a closed position and are shown in FIG. 1 in the operating position.

The coupling elements of the second type 36 are composed of a coupling plug 40 and a coupling piston 42 (cf. FIG. 6), in this case a valve plug and a valve piston. They can be designed as male or female coupling elements. It is preferably a quick-release coupling element.

Inside each coupling element of the second type 36, preferably in the coupling plug 40 or as part of the coupling element of the second type 36, a valve is provided which is open in the coupled state and closed in the uncoupled state.

Each coupling element of the second type 36, i.e. at least the coupling end section 35 of each coupling element of the second type 36, extends outwardly through a corresponding opening in the longitudinal housing wall 18 of the quick coupler 10 perpendicular to the longitudinal housing wall 18 of the quick coupler 10 in an operating position.

Figure 6:
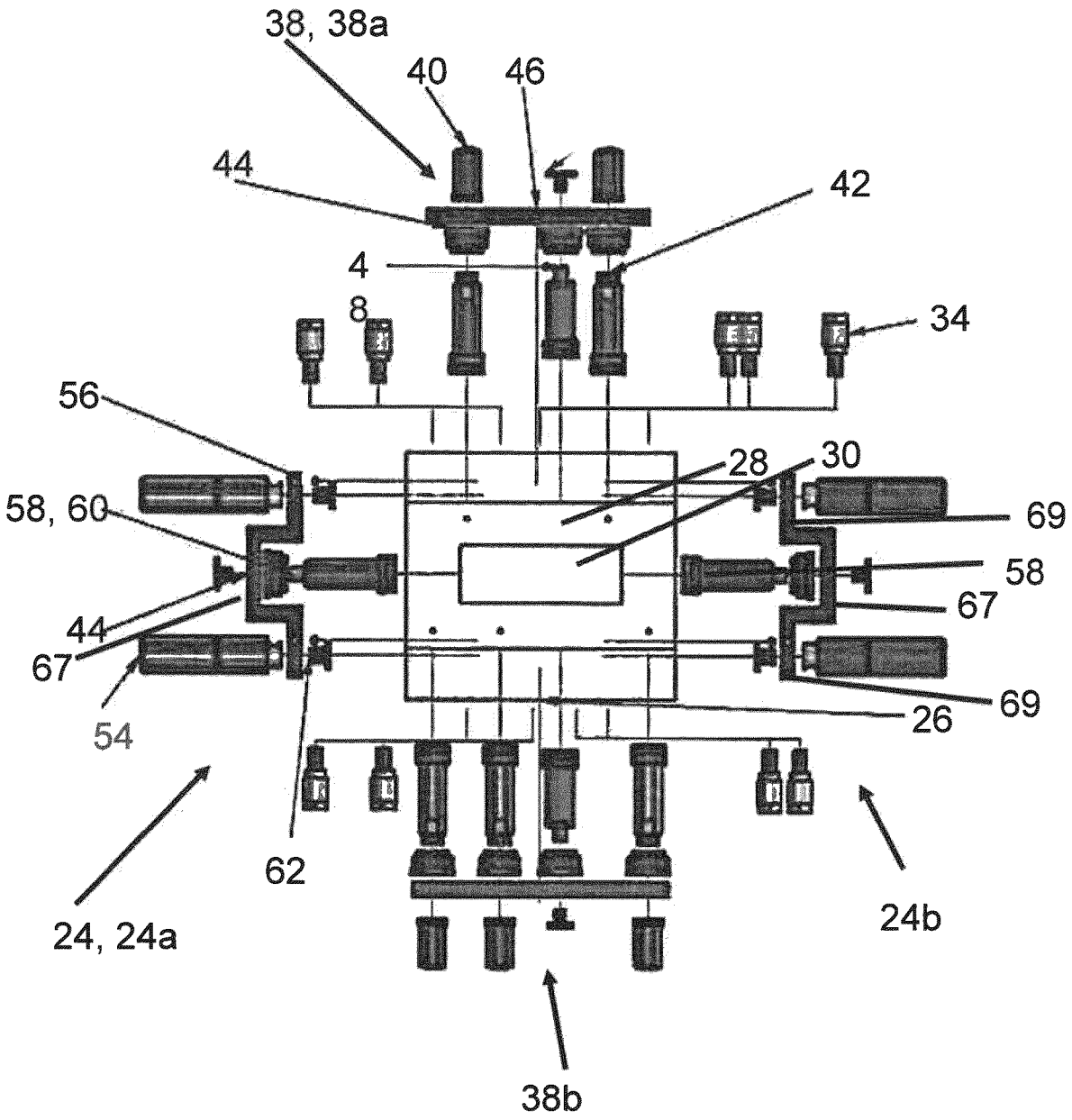
FIG. 6 shows an exploded view of the quick coupler without housing.

Inside the housing 12 of the quick coupler 10, the coupling pistons 42 of the coupling elements of the second type 36 extend into the first block cylinder 28 (cf. FIG. 6). Each coupling piston 42 of the coupling elements of the second type 36 is positioned in a recess 37 in the first block cylinder 28 (cf. FIG. 3 and FIG. 4).

Figure 2:
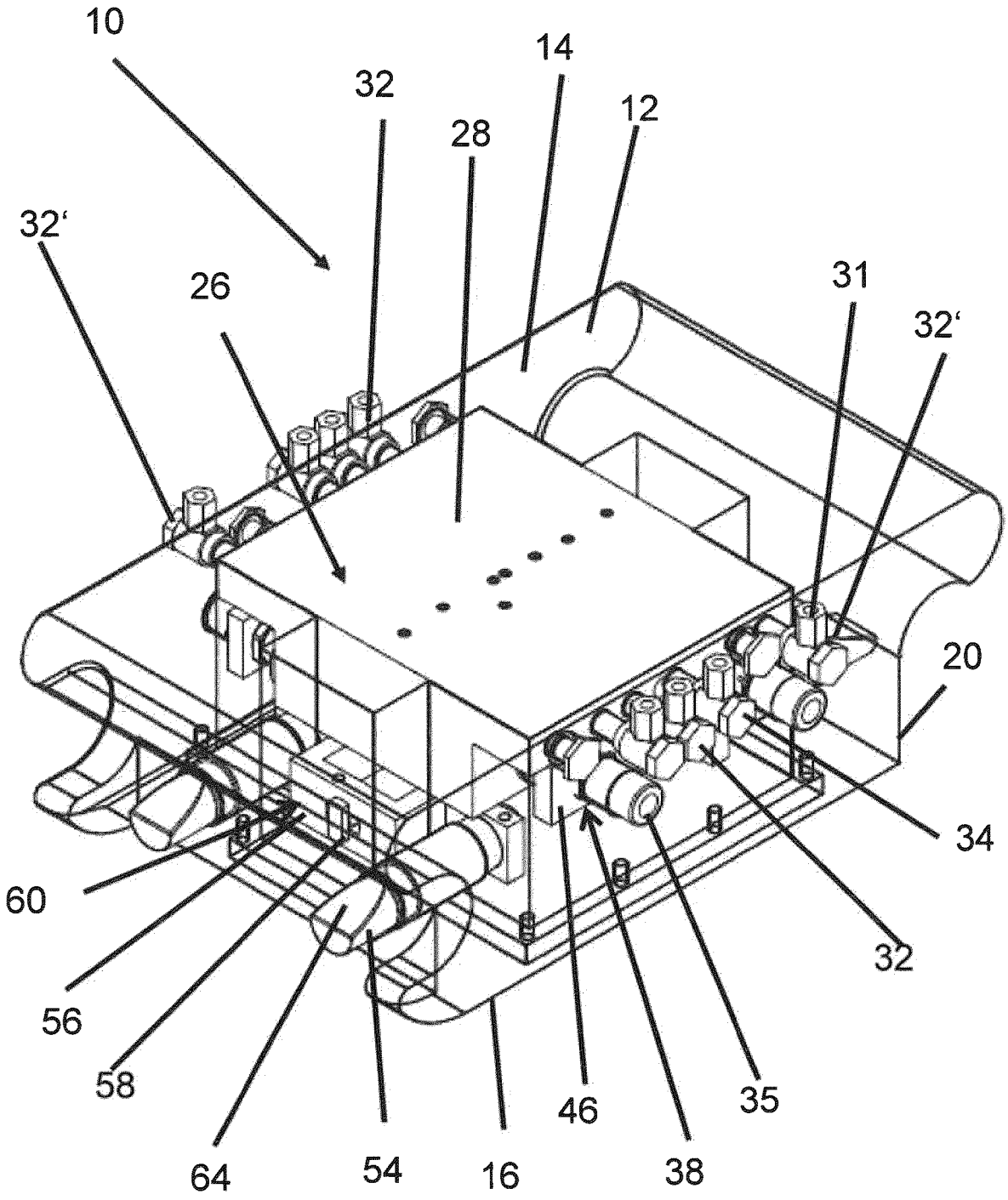
FIG. 2 shows a perspective transparency view of the quick coupler.

FIG. 2 shows a perspective transparency view of the quick coupler 10.

The block cylinder 26 arranged completely inside the housing 12 with a first block cylinder 28 and the second block cylinder 30 can be seen, wherein the block cylinder 26 is oriented in the housing such that the longitudinal axis of the housing 12 of the quick coupler 10 is parallel to the longitudinal axis of the block cylinders 28, 30 and vice versa.

Figure 4:
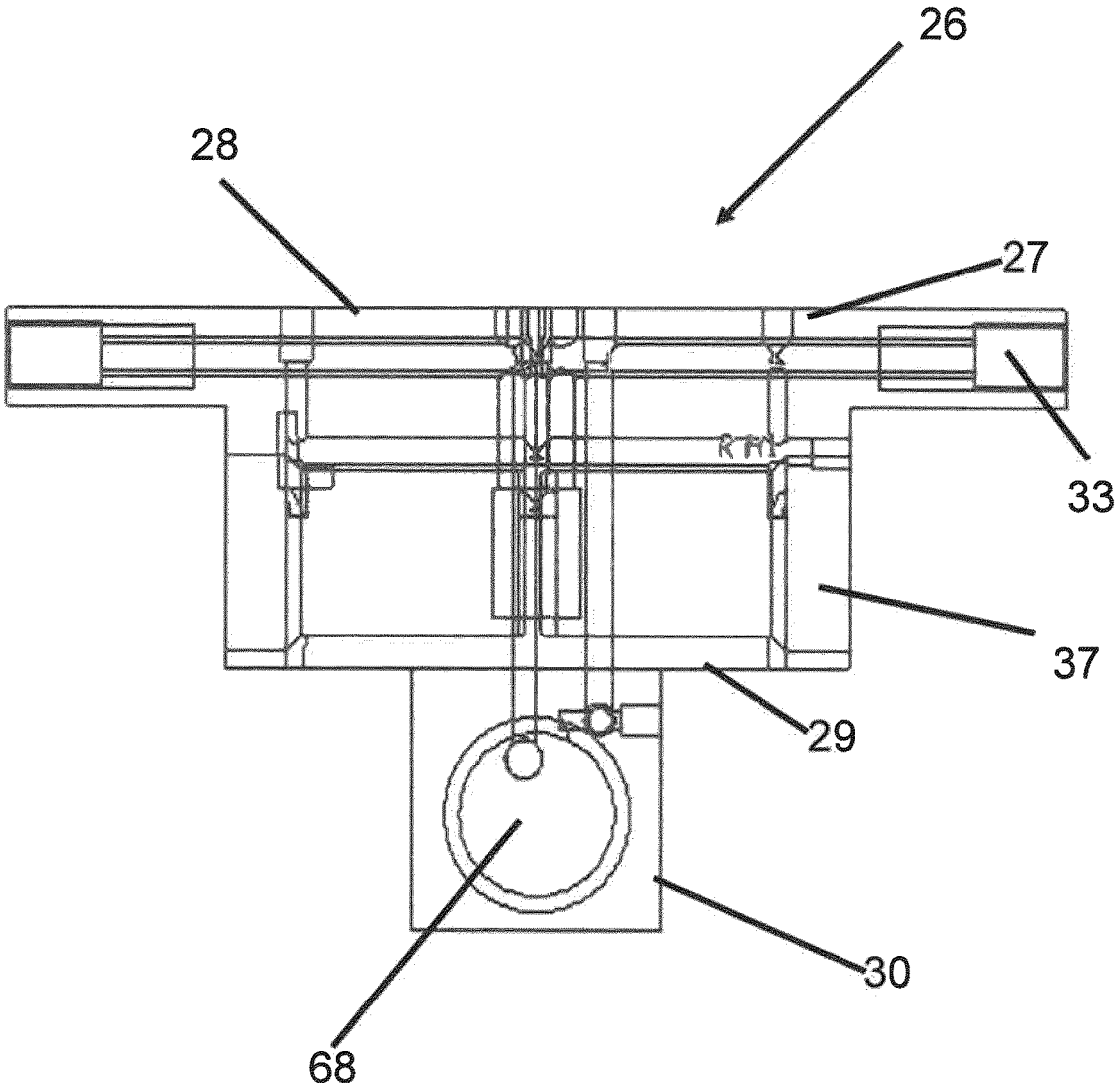
FIG. 4 shows a cross-sectional view of FIG. 3.

As can be seen in particular in FIGS. 3 and 4, the first block cylinder 28 has a T-shaped cross-section with a first plane 27 and a second plane 29. The second plane 29 of the first block cylinder 28 is set back from the first plane 27.

Below the first block cylinder 28 is the second block cylinder 30. The second block cylinder 30 is cuboidal with a square cross-section and is smaller than the first block cylinder 28. It extends at a distance from the edge of the first block cylinder 28 in the longitudinal direction of the first block cylinder 28, so that the block cylinder 26 tapers in cross-section from the first plane 27 of the first block cylinder 28 to the second block cylinder 30 in a step-like manner.

The first block cylinder 28 and the second block cylinder 30 can be connected to each other by screws, gluing, plugging or by other connections. The first block cylinder 28 and the second block cylinder 30 can also be integrally formed as a double block cylinder.

FIG. 2 shows an embodiment in which nine coupling elements of the first type 32 and/or coupling elements of the third type 32' are provided in the upper region of the first block cylinder 28. On one longitudinal wall of the first block cylinder 28 there are four, and on the opposite longitudinal wall of the first block cylinder 28 there are five.

Preferably, five of the coupling elements shown are coupling elements of the first type 32 and four of them are coupling elements of the third type 32'. The number of coupling elements of the first type 32 is preferably equal to the number of coupling elements 36 of the second type, since one coupling element of the first type 32 can be hydraulically coupled to one coupling element of the second type 36 in each case. The recesses 33 in the first block cylinder 28 are aligned with the corresponding openings in the housing 12, so that the coupling elements of the first type 32 and the coupling elements of the third type 32' in the openings of the housing 12 project into the recesses 33 of the first block cylinder 28.

Inside the first block cylinder 28 there are hydraulic lines and, if necessary, distribution devices which are hydraulically connected to these nine coupling elements. Five of these lines run inside the first block cylinder 28 to the second type 36 coupling elements located below the level of the first type 32 coupling elements, so that the first type 32 coupling elements and the second type 36 coupling elements are hydraulically connected to each other. It goes without saying that several devices of the first block cylinder 28 may also be interposed within this connection, which will not be discussed in more detail.

The lines of the coupling elements of the second type 36 also run into the first block cylinder 28 and are accordingly hydraulically connected to the coupling elements of the first type 32.

The number and distribution of the coupling elements of the first type 32 and/or the coupling elements of the third type 32' can vary (cf. e.g. FIG. 3).

In the embodiment of a block cylinder 28 shown in FIG. 3, preferably six recesses 33 are provided on a longitudinal wall of the first block cylinder 28 in the upper region, i.e. the first plane 27 of the first block cylinder 28, for receiving the coupling elements of the first type 32 and/or the coupling elements of the third type 32'. These six recesses 33 are arranged in series.

On the opposite longitudinal wall of the first block cylinder 28 (not shown), a further three recesses 33 for receiving the coupling elements of the first type 32 and/or the coupling elements of the third type 32', are preferably arranged in an analogous manner in the first plane 29 of the first block cylinder 28. These recesses 33 are also preferably arranged in series.

Advantageously, all recesses 33 are provided with a thread into which the coupling elements of the first type 32 and/or the coupling elements of the third type 32' can be screwed via a counter-thread. It is understood that the idea of the invention also includes alternative fastening variants or combinations thereof.

In the second plane 29 of the first block cylinder 28, a further four recesses 37 are provided on the shown longitudinal wall of the first block cylinder 28. On the opposite longitudinal wall of the first block cylinder 28, which is not shown, at least three further recesses 37 are let into the first block cylinder 28. The recesses 37 serve to support the coupling elements of the second type 36, whereby one of the recesses on each longitudinal wall of the first block cylinder 28 serves to support a coupling bridge piston 48.

The recesses 37 in the first block cylinder 28 align with the corresponding openings in the housing 12, so that the coupling elements of the second type 36 in the openings in the housing 12 project into the recesses 37 in the first block cylinder 28.

The coupling elements of the second type 36 are mounted in the recesses 37 where they can be adjusted, in particular mounted for movement. The coupling elements of the second type 36 can be adjustable as a whole, i.e. as a complete unit, in particular they can be moved, tilted and/or swivelled. Alternatively, however, only parts of a coupling element of the second type 36, such as the coupling end sections of the coupling elements of the second type 36, can be designed to be adjustable, in particular movable, tiltable and/or pivotable, with other parts of the coupling element of the second type 36 being firmly anchored in the recesses 37, e.g. by means of a thread.

In the mutually opposite end faces of the second block cylinder 30 there are recesses 68 which are connected to each other via a channel. A double-acting locking bridge piston 58 of a locking device 24 is movably mounted in this channel and can move in the longitudinal direction of the second block cylinder 30. The locking device 24 will be discussed in more detail below.

The coupling elements of the second type 36 are connected to a coupling drive device 38, which will be discussed in more detail below with reference to FIGS. 6 and 7.

FIG. 6 shows a top view of the quick coupler 10 without housing 12 in an exploded view. The second block cylinder 30 and the first block cylinder 28 arranged below the second block cylinder 30 can be seen. On the longitudinal walls of the first block cylinder 28 two or three coupling elements of the second type 36 are mounted in recesses 37 not shown.

The coupling elements of the second type 36 each comprise a coupling plug 40 and a coupling piston 42, the coupling pistons 42 being aligned parallel to one another. They are connected to a coupling drive device 38 which can move the coupling elements of the second type 36 between a basic position (protective position) and an operating position (coupling position).

For this purpose, the coupling drive device 38 comprises a partial coupling drive device 38*a* and 38*b* on each longitudinal wall of the first block cylinder 28. The partial coupling drive devices 38*a* and 38*b* are mirror-symmetrical.

Each partial coupling drive device 38*a*, 38*b* comprises a coupling bridge 46 and a coupling bridge piston 48 which can be acted upon on both sides. The coupling bridge 46 is rectangular in cross-section.

The coupling bridge piston 48 is firmly connected to the coupling bridge 46, for example via a screw.

Each coupling bridge 46 is connected to at least three guide devices 44 on the block cylinder side. The number of guide devices 44 corresponds to the number of coupling elements of the second type 36 plus the number of coupling bridge pistons 48. The guide devices 44 are preferably ring-like and enclose through-openings of the coupling bridge 46 on the block cylinder side.

On the side of the coupling bridge 46 facing away from the block cylinder, the coupling plugs 40 of the coupling elements of the second type 36 are positioned in the region of the openings of the coupling bridge 46, preferably firmly connected to the coupling bridge 46.

In each guide device 44 and in the corresponding through-opening in the coupling bridge piston 48, at least one section of a coupling bridge piston 48 is movably mounted perpendicular to the longitudinal direction of the first block cylinder 28 or, alternatively, is fixedly connected in sections to the guide device 44 and/or to the edge of the opening of the coupling bridge 46, depending on whether only the coupling plug 40 or the entire coupling element of the second type 36 is designed to be movable.

The coupling bridge piston 48 is mounted in a recess 37 in the first block cylinder 28 and is hydraulically connected to at least one coupling element of the third type 32'.

Each coupling bridge piston 48 can move between at least two positions, a position close to the block cylinder and a position away from the block cylinder.

In the position of the coupling bridge pistons 48 close to the block cylinder, the two coupling bridges 46 of the partial coupling drive devices 38*a* and 38*b* are correspondingly also in a position close to the block cylinder and thus the coupling end sections such as the coupling plugs 46 of the coupling elements of the second type 36 as well. Preferably, the coupling drive device 38 is dimensioned such that in this position the coupling plugs 46 are entirely contained within the housing 12 of the quick coupler 10, which is not shown, which means the entire coupling elements of the second type 36 are contained within the housing 12. This position is the basic position (protective position) of the coupling elements of the second type 36.

The coupling bridge pistons 48 can be moved from the normal position to the position away from the block cylinder, which means that the coupling plugs 46 or the coupling plugs 46 with coupling pistons 42 can also be moved to the position away from the block cylinder.

In this case, the coupling drive device 38 is dimensioned in such a way that at least one coupling end section, preferably the entire coupling plug 46 of each coupling element of the second type 36 is located outside the housing 12 of the quick coupler 10 in the position away from the block cylinder. This position is the operating position (coupling position) of the coupling elements of the second type 36.

The control of the coupling bridge pistons 48 is effected via at least one coupling element of the third type 32', which can be coupled with the hydraulic system of a construction machine. The two partial coupling drive devices 38*a*, 38*b* are preferably movable synchronously, i.e. together.

Figure 7:
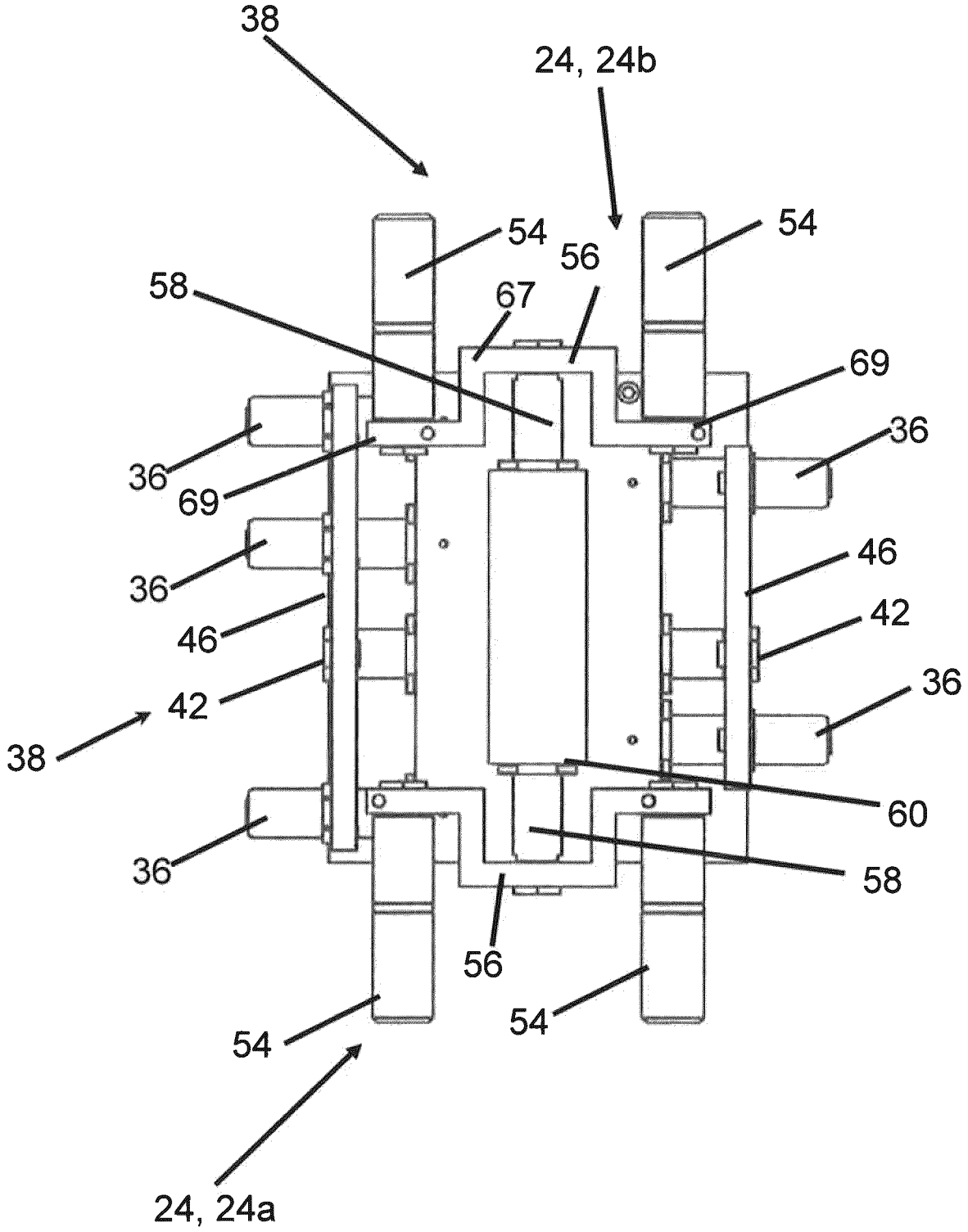
FIG. 7 shows a schematic representation of the quick coupler without housing according to FIG. 6.
Figure 8:
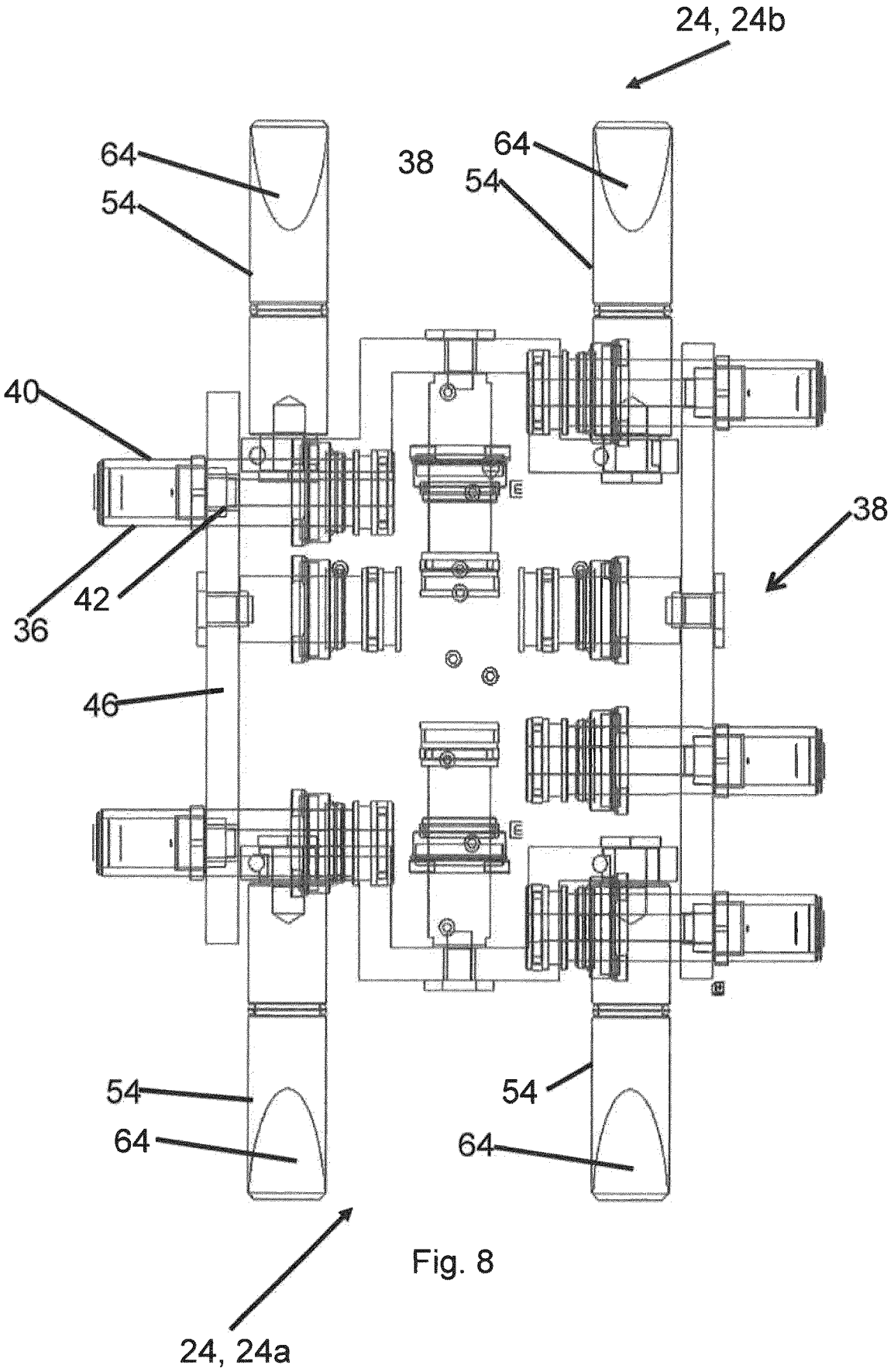
FIG. 8 shows a design drawing of FIG. 7.

Furthermore, the locking device 24 is clearly visible in FIGS. 6 to 8.

The locking device 24 comprises, on each transverse side of the second block cylinder 30, a first partial locking device 24*a* and a second partial locking device 24*b* extending in the longitudinal direction of the second block cylinder 30. The partial locking devices 24*a* and 24*b* are of mirror-symmetrical design.

Each partial locking device 24*a*, 24*b* comprises a respective locking bridge 56 and a bolt drive 60 with a locking bridge piston 58.

The locking bridge piston 58 is thus aligned perpendicular to the coupling pistons 42.

The locking bridge 56 may be divided into a middle section 67 and two oppositely directed end sections 69 extending to the left and right of the middle section 67 of the locking bridge 56. The end sections 69 are in line and set back from the middle section 67 of the locking bridge 56 towards the second block cylinder 30. In other words, the middle section 67 of the locking bridge 56 is spaced further from the second block cylinder 30 than the end sections 69 of the locking bridge 56.

The locking bridge piston 58 is a conventional piston with a section movably mounted inside the second block cylinder 30 and delimits at least one hydraulic chamber inside the second block cylinder 30. According to the invention, the overall system is referred to as a bolt drive 60, whereby alternative bolt drives 60 can also be realised according to the invention, for example an electric drive.

With its end section away from the block cylinder, the locking bridge piston 58 is firmly connected, preferably screwed, to the locking bridge 56 in the area of the middle section 67 of the locking bridge 56.

In the area of the end sections 69 of the locking bridge 56, a locking bolt 54 is attached in each case, preferably screwed on. The locking bolts 54 extend away from the second block cylinder 30. They preferably extend parallel to each other and form a pair of locking bolts 54. Each locking bolt 54 is provided with a centering section 64 (cf. FIG. 8).

Each partial locking device 24*a* and 24*b* is preferably individually controllable, so that each locking bridge piston 58 of each partial locking device 24*a* and 24*b* can move separately between at least two positions, a position close to the block cylinder and a position far from the block cylinder.

In the position of the locking bridge piston 58 of a partial locking device 24*a* and 24*b* close to the block cylinder, the corresponding pair of locking bolts 54 with the corresponding locking bridge 56 is also in a position close to the block cylinder. According to the invention, this position of the pair of locking bolts 54 is referred to as the open position.

Each locking bridge piston 58 and thus also each pair of locking bolts 54 can be moved from the open position to the position away from the block cylinder. According to the invention, this position is the closed position. In this position, the locking bolts protrude through openings in the transverse wall of the housing 12.

Figure 5:
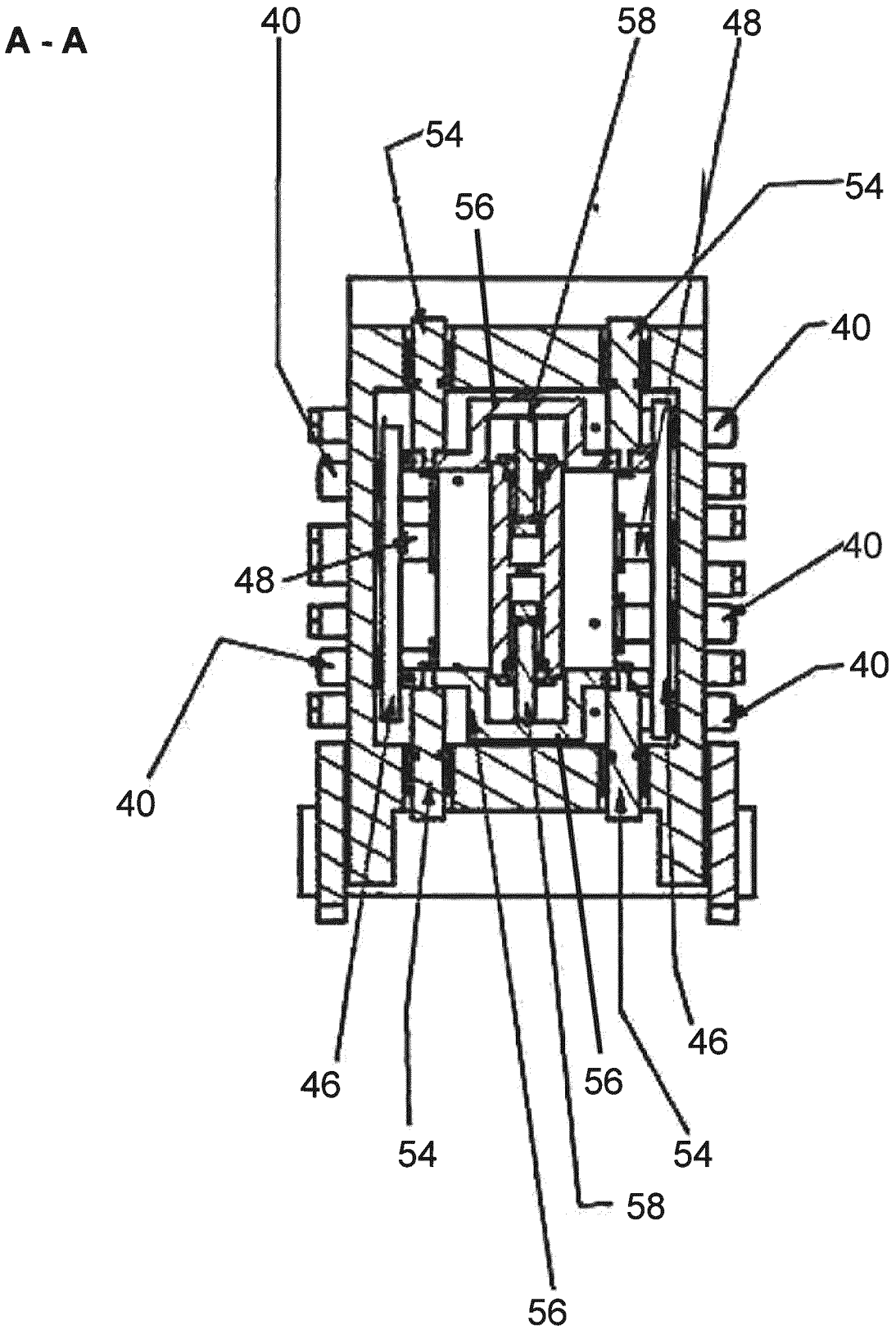
FIG. 5 shows a cross-sectional view of FIG. 1 after a section according to A-A.

FIG. 5 shows a cross-sectional view of FIG. 1 after a cut according to A-A. For details, please refer to the explanations in relation to FIGS. 6 to 8.

Figure 9:
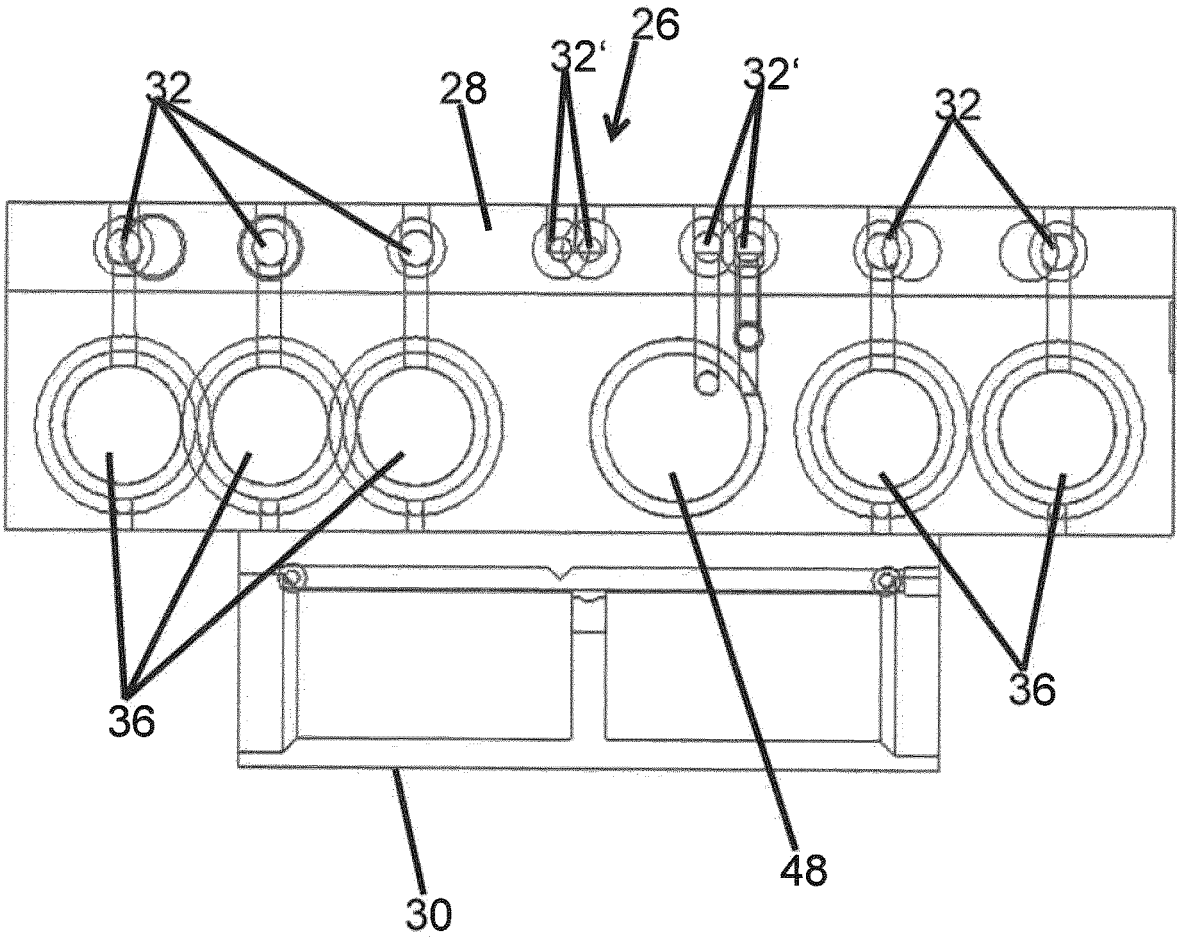
FIG. 9 shows a schematic representation of the hydraulic connections between the coupling elements of the first type or the coupling elements of the third type and the coupling elements of the second type.

FIG. 9 shows a schematic representation of the hydraulic connections between the coupling elements of the first type 32 and the coupling elements of the second type 36, as well as the coupling elements of the third type 32' and the coupling bridge pistons 48. Five coupling elements of the first type 32, four coupling elements of the third type 32' and five coupling elements of the second type 36 are shown. Each coupling element of the first type 32 is hydraulically connected to a coupling element of the second type 36. Two coupling elements of the third type 32' are hydraulically connected to the coupling bridge pistons 48. The remaining two coupling elements of the third type 32' in the middle of the first block cylinder 28 are hydraulically connected with the locking bridge pistons 58 of the second block cylinder 30 (not shown).

The coupling elements of the first type 32 and the coupling elements of the third type 32' are directly couplable to the hydraulic system of a construction machine, whereas the coupling elements of the second type 36 are couplable to the hydraulic system of an adapter 70.

Figure 10:
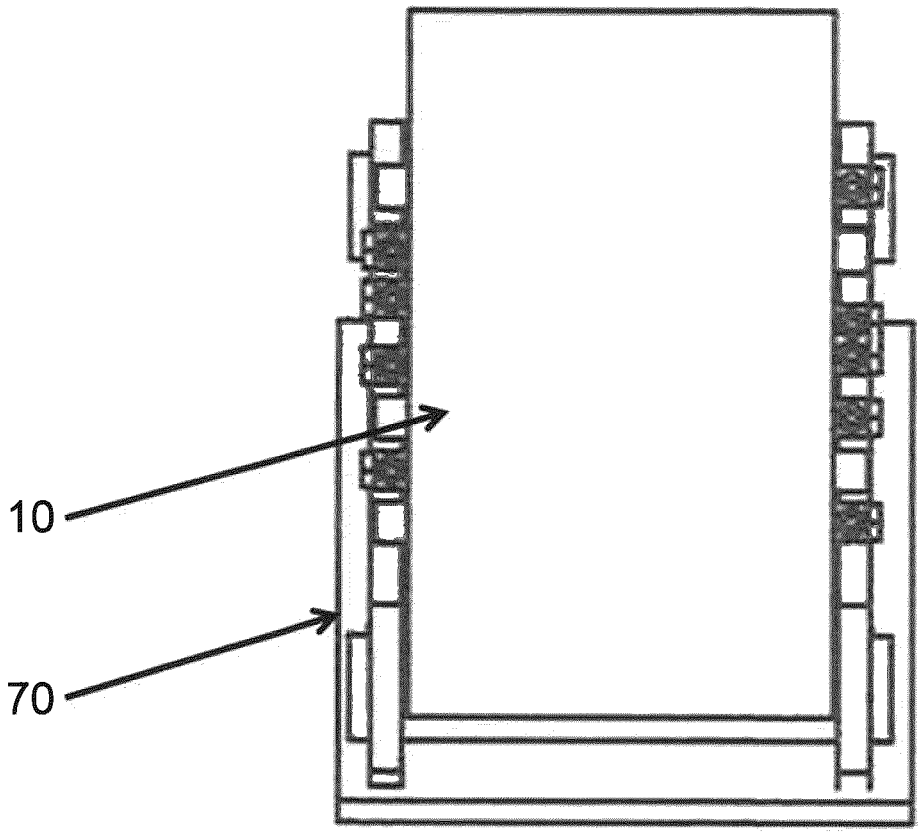
FIG. 10 shows a top view of the quick coupler system in the coupled state.
Figure 11:
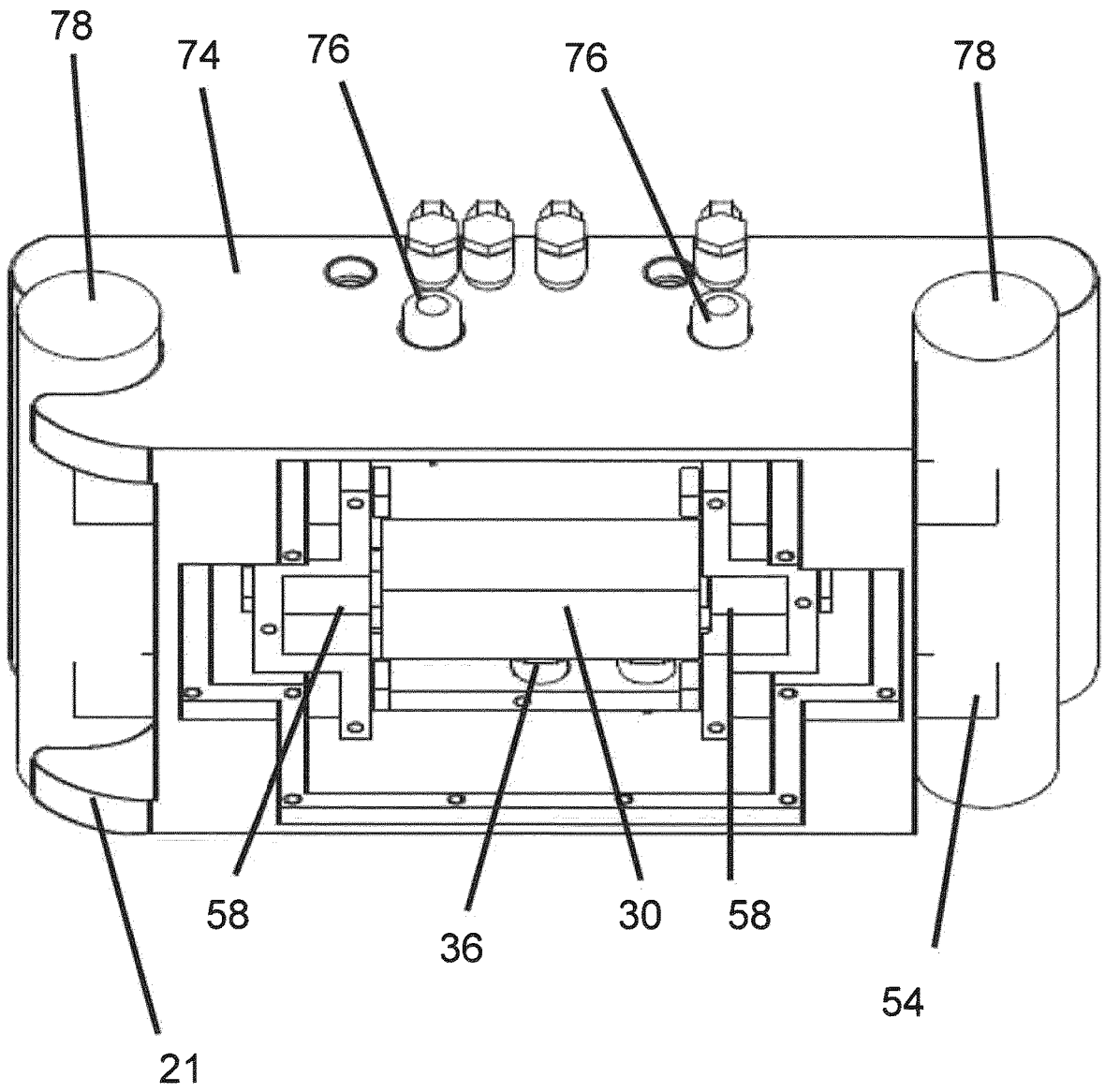
FIG. 11 shows a perspective partial cross-sectional view of the quick coupler system in the coupled state.

FIGS. 10 and 11 show the quick coupler system in the coupled state. Together with FIG. 1, the coupling between the quick coupler 10 and the adapter 70 is now described in more detail.

The starting point is that the quick coupler 10 is mounted in the usual way on a boom of a construction machine. The hydraulic hoses of the construction machine with their counter coupling elements of the second type are attached to the coupling elements of the first type 32 and the coupling elements of the third type 32' of the quick coupler 10, so that the hydraulic system of the quick coupler 10 is coupled to the hydraulic system of the construction machine. The hydraulic system of the quick coupler 10 is then under permanent pressure during the coupling process, in particular the at least one coupling element of the second type 36, the at least one coupling drive device 38 and the at least one locking device 24.

In order to connect the quick coupler 10 to the adapter, two different coupling scenarios are conceivable depending on how far the locking bolts 54 of the locking device 24 protrude from the housing 12 of the quick coupler 10 in the open position of the locking device 24 and how far the corresponding transverse bolts 78 of the adapter 70 are spaced apart from each other, both of which scenarios are encompassed by the idea of the invention and are described below.

In the first scenario, with the locking bolts 54 of the locking device 24 in the open position tight against the housing 12 and/or the transverse bolts 78 of the adapter 70 being widely spaced, the quick coupler 10 is guided over the adapter 70 until it is aligned with the adapter. The quick coupler 10 can then be lowered until the lower housing wall 16 of the quick coupler 10 rests on the bottom 72 of the adapter 70 and the longitudinal adapter walls 74 of the adapter 70 frame the quick coupler 10. In this position, the locking bolts 58 can extend to the closed position on the opposite sides of the quick coupler 10 in the manner described and engage under the transverse bolts 78 of the adapter 70.

In a further step, the coupling elements of the second type 36, driven by the coupling drive device 38, can extend perpendicularly to the longitudinal wall of the housing 18 of the quick coupler 10 until they are hydraulically coupled to the counter coupling elements of the second type 76 on the adapter 70. The counter coupling elements of the second type 76 on the adapter are connected to further hydraulic hoses, so that the working tool on the adapter 70 is now coupled to the hydraulic system of the quick coupler 10 and thus also to the hydraulic system of the construction machine. The working tool is immediately ready for use.

In the second scenario, the quick coupler 10 is positioned at an angle to the adapter 70 and lowered until a first transverse bolt 78 of the adapter 70 slides into the space between the projection 21 on the quick coupler 10 and the same-sided first pair of locking bolts 54. The quick coupler 10 then swivels into a locked position in which the oppositely positioned pair of locking bolts 54 is below the second transverse bolt 78 of the adapter 70 and the longitudinal adapter walls 74 of the adapter 70 embrace the quick coupler 10. Now the pairs of locking bolts 54 arranged on the quick coupler 10 and facing in opposite directions move into their closed position and thus ensure the secure connection between the quick coupler 10 and the adapter 70.

In a further step, the coupling elements of the second type 36 now extend to couple with the counter coupling elements of the second type 76 on the adapter 70, as already described above.

Uncoupling between adapter 70 and quick coupler 10 is done accordingly in reverse order.

The number and distribution of the coupling elements of the first type 32, the coupling elements of the second type 36 and the coupling elements of the third type 32' can vary according to requirements.

In the embodiments shown so far, the number of coupling elements on both sides of the quick coupler is different. In an embodiment shown in FIG. 12, the number of coupling elements is the same on both sides. Thus, in the embodiment shown in FIG. 12, the quick coupler system 110 has two coupling elements of the second type 136 and two counter-coupling elements of the second type 176, respectively, on each of the two longitudinal walls of the quick coupler 110 and the adapter 170. They are even arranged symmetrically. It is understood that the number of coupling elements of the second type or of the counter coupling elements of the second type and/or their arrangement may vary depending on the requirements of the quick coupler system.

Figure 12:
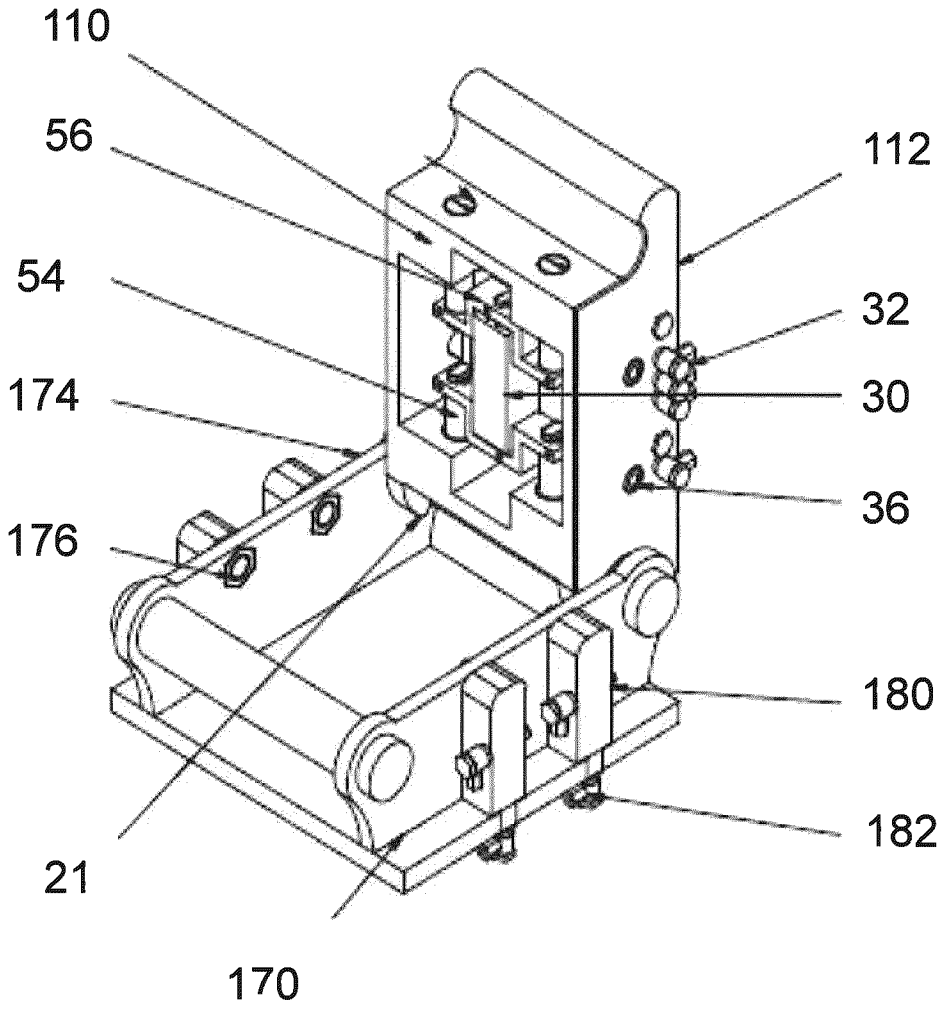
FIG. 12 shows an alternative embodiment of a quick coupler in perspective view and FIG. 13 shows an alternative embodiment of a block cylinder with locking and coupling elements.

In the adapter 170 shown in FIG. 12, the counter coupling element of the second type 176 is formed as a connection block 180 on the longitudinal wall 174 of the adapter, in which the part of the counter coupling element projecting from the adapter 170 is angled so that the outlet 182 of the counter coupling element of the second type 176 faces downwards.

Figure 13:
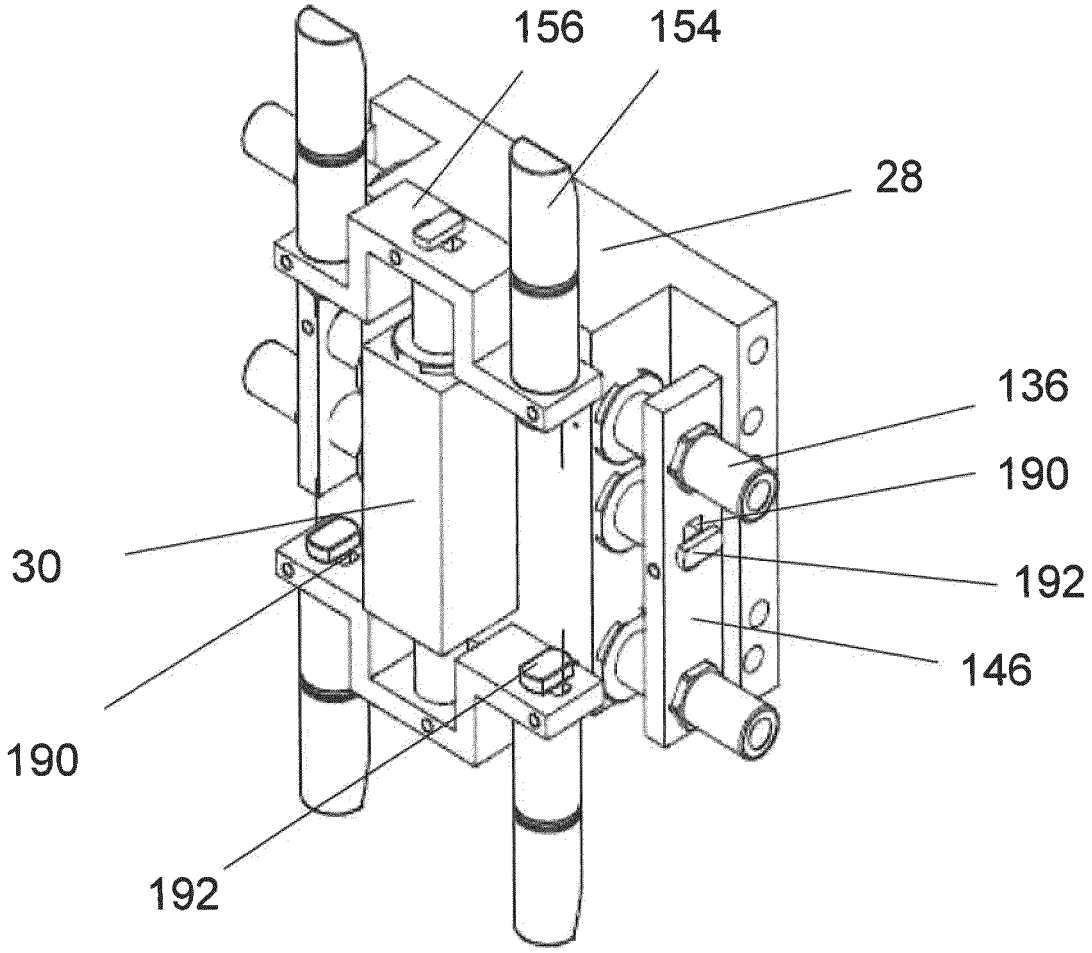

While in the embodiment shown in FIGS. 1 to 11 the locking bolt 154 or the locking bridge piston 158 is screwed to the locking bridge 156, FIGS. 12 and 13 show an embodiment of a quick coupler 110 in which a rotary lock is provided instead of the screw connection. For this purpose, an elongated hole 190 is provided in the locking bridge 156 and the locking bolt 154 or the locking bridge piston have a bolt with an elongated head 192 on their front side. The locking bolt 154 or the locking bridge piston are inserted into the elongated hole 190 by means of a bolt with an elongated head 192 and are rotated for fastening so that the elongated head 192 is aligned perpendicular to the elongated hole 190. In an analogous manner, the coupling elements of the second type 136 are attached to the coupling bridge 146.

The idea of the invention also includes a locking device 24 which is only equipped on one side with a pair of locking bolts 54 and on the opposite side, as known in the prior art, for example a projection can be arranged on the housing.

It goes without saying, that within the scope of the invention, individual features illustrated in connection with one embodiment may be combined with one another.

The invention claimed is:

1. A quick coupler as part of a quick coupler system for construction machines, comprising:

a housing (12; 112) with two opposing longitudinal walls (18), two opposing transverse walls (20), a top side and a bottom side;

a block cylinder (28, 30) inside the housing (12; 112);

a locking device (24) with at least two locking bolts (54; 154) which point in opposite directions, and which are adjustable between a closed position and an open position and vice versa by means of a locking drive device;

wherein the at least two locking bolts (54; 154) protrude from one of the two transverse walls (20) in a locked position; and at least one first coupling element (32) having a coupling end section (31) and at least one second coupling element (36; 136) having a coupling end section (35), wherein the at least one first coupling element (32) and the at least one second coupling element (36; 136) are hydraulically connected to one another, and wherein the at least one second coupling element (36; 136) is arranged on one of the two longitudinal walls (18) of the housing (12; 112).

2. The quick coupler (10; 110) according to claim 1, characterized in that the at least one first coupling element (32) is arranged on one of said two opposing longitudinal walls (18) of the housing (12; 112).

3. The quick coupler according to claim 1, characterized in that at least the coupling end section (35) of the second coupling element (36; 136) is adjustable between an operating position and a basic position, wherein the coupling end section (35) of the second coupling element (36; 136) protrudes from the longitudinal wall 18 of the housing (12; 112) in the operating position.

4. The quick coupler according to claim 3, characterized in that the at least one second coupling element (36; 136) is connected to a coupling drive device (38) so that at least the second coupling end section (35) of the second coupling element (36; 136) is adjustable between the basic position and the operating position and vice versa.

5. The quick coupler (10; 110) according to claim 4, characterized in that at least one third coupling element (32') is provided, which is positioned in one of the two longitudinal walls (18) of the housing (12; 112).

6. The quick coupler (10; 110) according to claim 4, characterized in that the quick coupler (10; 110) is equipped with at least two second coupling elements (36; 136), wherein at least the coupling end sections (35) of the second coupling elements (36; 136) are synchronously adjustable between the basic position and the operating position and vice versa.

7. The quick coupler (10; 110) according to claim 4, characterized in that at least two second coupling elements (36; 136) are provided, which are positioned on opposite longitudinal walls (18) of the housing (12; 112) and are adjustable by means of the coupling drive device (38), the coupling drive device (38) having a double-acting hydraulic cylinder which is aligned parallel to the transverse wall (20) of the housing (12; 112).

8. The quick coupler (10; 110) according to claim 1, characterized in that the locking drive device comprises a double-acting hydraulic cylinder which is aligned parallel to the longitudinal wall (20) of the housing (12; 112).

9. The quick coupler (10; 110) according to claim 8, characterized in that the locking drive device comprises a locking bridge (56; 156).

10. The quick coupler (10; 110) according to claim 1, characterized in that the block cylinder (26) comprises a first block cylinder (28) and a second block cylinder (30), wherein the second block cylinder (30) is positioned below the first block cylinder (28), wherein the at least one second coupling element (36; 136) is provided in the first block cylinder (28), and wherein at least a part of the locking device (24) is positioned in a plane of the second block cylinder (30).

11. The quick coupler (10; 110) according to claim 10, characterized in that the locking device (24) comprises at least one locking drive device with a locking piston, with the locking piston being positioned inside the second block cylinder (30).

12. The quick coupler (10; 110) according to claim 10, characterized in that at least the coupling end section (35) of the second coupling element (36; 136) is adjustable between an operating position and a basic position, and in that a coupling drive device (38) is provided, with the coupling drive device (38) being arranged in the first block cylinder (28).

13. The quick coupler (10; 110) according to claim 10, characterized in that an opening (37) for the second coupling element (36; 136) is provided in a longitudinal wall of the first block cylinder (28) and that an opening (68) is provided in the second block cylinder (30) at the transverse side of the block cylinder (26).

14. The quick coupler (10; 110) according to claim 10, characterized in that the first block cylinder (28) is T-shaped in cross-section with a base and a roof, with the at least one first coupling element (32) being positioned in a plane of the roof and the at least one second coupling element (36; 136) being positioned in a plane of the base.

15. A quick coupler system comprising a quick coupler (10; 110) according to claim 1 and an adapter (70; 170) connectable to a working tool, wherein the quick coupler (10; 110) is mechanically and hydraulically couplable to the adapter (70; 170).

16. The quick coupler system according to claim 15, characterized in that the adapter (70; 170) comprises two opposing longitudinal adapter sides (74; 174) and two transverse bolts (78), wherein the two transverse bolts (78) are each connected at their end portions to the longitudinal adapter sides (74; 174) of the adapter (70; 170).

17. The quick coupler system according to claim 16, characterized in that at least one second counter-coupling element (76; 176) is positioned on at least one longitudinal wall (74; 174) of the adapter (70; 170), wherein said second counter coupling element can be hydraulically connected to the at least one second coupling element (36; 136).

18. The quick coupler system according to claim 17, characterized in that the at least one second counter-coupling element (76; 176) is designed as a connection block (180).

* * * * *